United States Patent [19]

Schaul et al.

[11] Patent Number: 5,004,270

[45] Date of Patent: Apr. 2, 1991

[54] BUYING GUIDE

[76] Inventors: Malcolm Schaul, 9 Jack La., Marlboro, N.J. 07746; James Broderick, 2930 Point East Dr., Bld. E Apt. E 601, N. Miami Beach, Fla. 33160

[21] Appl. No.: 395,501

[22] Filed: Aug. 17, 1989

[51] Int. Cl.[5] ..... B42D 15/00

[52] U.S. Cl. ..... 283/48.1; 40/299; 283/56

[58] Field of Search ..... 40/308, 299; 116/306, 116/323; 206/425, 452; 283/117, 56, 48.1

[56] References Cited

U.S. PATENT DOCUMENTS

| | | | |
|---|---|---|---|
| 489,060 | 1/1893 | Wilheim | 283/48.1 X |
| 1,689,444 | 10/1928 | Manshel | 40/299 |
| 1,729,916 | 10/1929 | Vernon | 283/48.1 X |
| 2,279,189 | 4/1942 | Uhlir | 116/306 |
| 2,712,810 | 7/1955 | Ranko et al. | 116/306 |
| 2,888,761 | 6/1959 | Miller | 40/308 |
| 3,884,507 | 5/1975 | Fumel | 40/299 X |
| 4,506,913 | 3/1985 | Kim | 283/56 |
| 4,520,958 | 6/1985 | Jones et al. | 229/72 |
| 4,591,054 | 5/1986 | Blossom | 206/452 |
| 4,619,457 | 10/1986 | Small | 273/269 |
| 4,636,179 | 1/1987 | Gentile et al. | 402/79 |
| 4,637,337 | 1/1987 | Murray | 116/323 |
| 4,685,998 | 8/1987 | Hirasawa | 281/15 R |
| 4,742,911 | 5/1988 | Manuel | 206/425 |
| 4,795,196 | 1/1989 | Hyun et al. | 283/67 |

*Primary Examiner*—Paul A. Bell

[57] ABSTRACT

A novel buying guide means detachably secured to a newspaper or magazine insert is provided. The multi-page buying guide includes check list with indicators to note and organize an inventory of shopping items and coupons from the accompanying newspaper or insert. Redeemable coupons for use in conjunction with the buying guide are provided in the accompanying insert. The buying guide further includes pouch means within the guide for coupons representing products indicated on the guide. Indicators are printed adjacent selected products to notify the buyer that coupons related to particular items on the checklist are located in the accompanying insert.

3 Claims, 3 Drawing Sheets

BUYING GUIDE

FIELD OF THE INVENTION

The invention relates in general to printed matter, and in particular to a promotional article incorporating a buying guide, for listing consumer items and collecting selected coupons, provided in an accompanying newspaper insert.

BACKGROUND OF THE INVENTION

The Sunday supplement enclosed in the Sunday paper distributed in large metropolitan areas includes hundreds of coupons which present discounts to the public on new products and services in order to promote sales and educate the public about the different products available on the market. The number of coupons is often times so overwhelming that the consumer may not have time to sort through all of the coupons in order to find savings on only the particular items on the weekly shopping list. Moreover, once the coupons have been removed from the Sunday supplement, the coupons are often misplaced, or thrown away. If the consumer saves the coupons there is a lack of organization in matching the coupons with products on the shopping list.

Many vehicles and structures have been developed to meet these needs of organization for the consumer. A typical printed structure for preparing a shopping list in wide use today includes an ordinary check-list through which the consumer can check off items needed for the household. Such checklist articles often include pads of printed sheets having checklists of consumer items on each sheet.

One such reminder appliance is disclosed in U.S. Pat. No. 2,279,189 to C. H. Uhlir. The patent illustrates a reminder appliance useful in the home, to enable a person to quickly provide an indication on the appliance by which to check and remind them to procure certain supplies for the home, such for provisions for the table, drugs, or anything of this sort.

An improvement of the Uhler reminder appliance is taught in U.S. Pat. No. 4,742,911 to Manuel, which discloses a grocery list device in the form of a box including several sets of index strips, each strip indicated with the name of a different food or non-food item, and snap-on indicators that clip on selected ones of the index strips to indicate items needed to purchase. Unfortunately, the box is awkward and merely serves as a remainder in order to inventory needed grocery items. The consumer must review the entire coupon insert in order to match coupons with checklist items. The box must be separately purchased and there is no relationship between the box and the coupons available in the newspaper or insert and advertising materials. Accordingly, there is a need for a device that will reduce the time and effort it takes for a consumer to checklist grocery items and more particularly a need for a device that will direct a consumer to coupons of interest.

SUMMARY OF THE INVENTION

Therefore, it is a principle object of the present invention to provide a combination buying guide and check list device that accompanies a coupon insert that indicates coupon items available in the accompanying coupon insert materials.

Another object is to provide a combination buying guide and check list device which makes it easier to include all items within a specific category when getting into a store department and providing the necessary coupons for items available in that department.

Another object is to provide a combination buying guide and check list device which includes indicator means that notifies the consumer that coupons for selected items are available in accompanying insert materials.

Yet a further object is to provide a detachable buying guide and check list device which is simple in design, inexpensive to manufacture and provided by the promoter as part of the insert materials. These and other objects, will be readily evident upon a study of the following specifications and the accompanying drawings.

DETAILED DESCRIPTION

Figure 1:
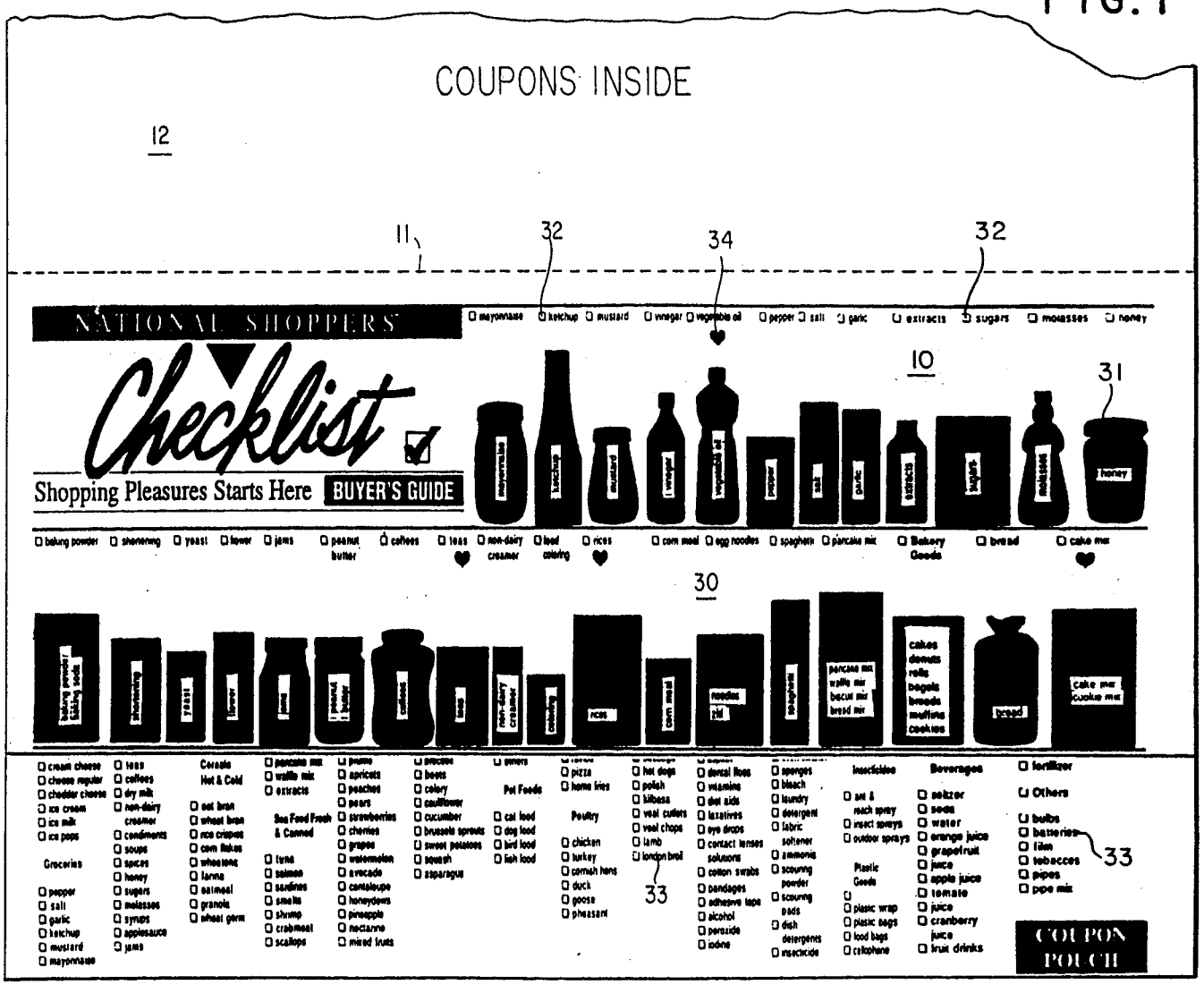
FIG. 1 is an open perspective view of a combination buying guide device detachably secured to a newspaper insert.

Referring now to the drawings in greater detail, FIG. 1 of the present invention illustrates a buying guide (10) secured at (11) to a newspaper insert (12). The buying guide may be detachably secured by a perforated line (11) such that the guide may be torn away from the insert. If the buying guide is secured within the center section of the insert, fugitive glue or saddle stitches may be used as a means for detachably adhering the guide to the insert. Two spots of fugitive along the outside edge of the guide is sufficient to bind the article and the guide.

Figure 2:
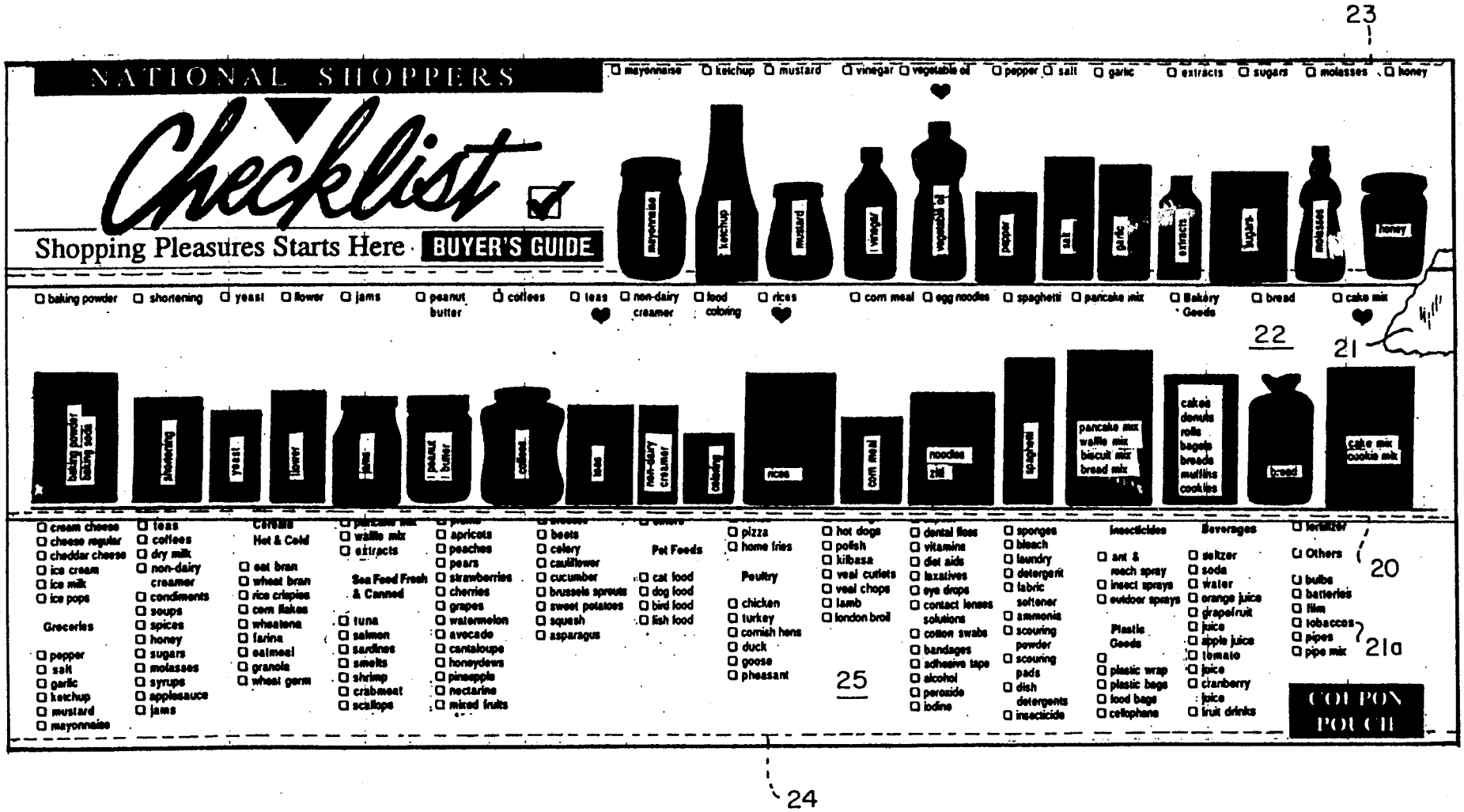
FIG. 2 is front perspective view of the invention in the closed position.

As shown in FIG. 2, the buying guide may be made of a sheet of paper, cardboard material, or any equivalent materials dependent on the particular use of the guide, the length of its use and the conditions to which it will be subjected in use as to wear and tear. In its preferable embodiment, the guide is made in its original blank form as per its construction from a sheet of paper twelve and one-half by ten and three-quarter inches with three folds.

A first fold (20) is one and three quarter inches from the top and is designed to bend under to create a short page (21) allowing a display of the check list (**21*a*). A second fold (23) is the center fold, five and three-eighths inches from the top of the paper and designed to reduce the size of the check list. This size is convenient for the shopper to fit the guide in a purse/coat pocket for a trip to the grocery store. A third fold (24), is two inches from the bottom folded upwardly, and designed to be glued one-quarter inch on each side. The third fold creates a pouch (25) to hold cut-out coupons (26) for the consumer to use along with the visual check list. FIG. 2** illustrates use of the pouch with the coupon partially inserted therein.

Returning to FIG. 1, in order to assist the consumer in preparing a shopping list and obtaining the lowest price for each item on that list, check list indicia (30) is provided on the buying guide. The checklist indicia includes graphic illustrations (31) which provide the user with a visual of how the actual product appears on the shelf and also provides the user with a checklist box (32) and product name (33).

Adjacent each listed product having a related coupon within the brochure is an indicator (34) in the form of a heart, diamond or any capable indicator device. The indicator, which is in the form of a heart, alerts the consumer that a coupon for the adjacent product is available in the insert. Thus the consumer may, after preparing the grocery list, check the insert for coupons on that particular product without having to needlessly search for potential coupons.

Figure 3:
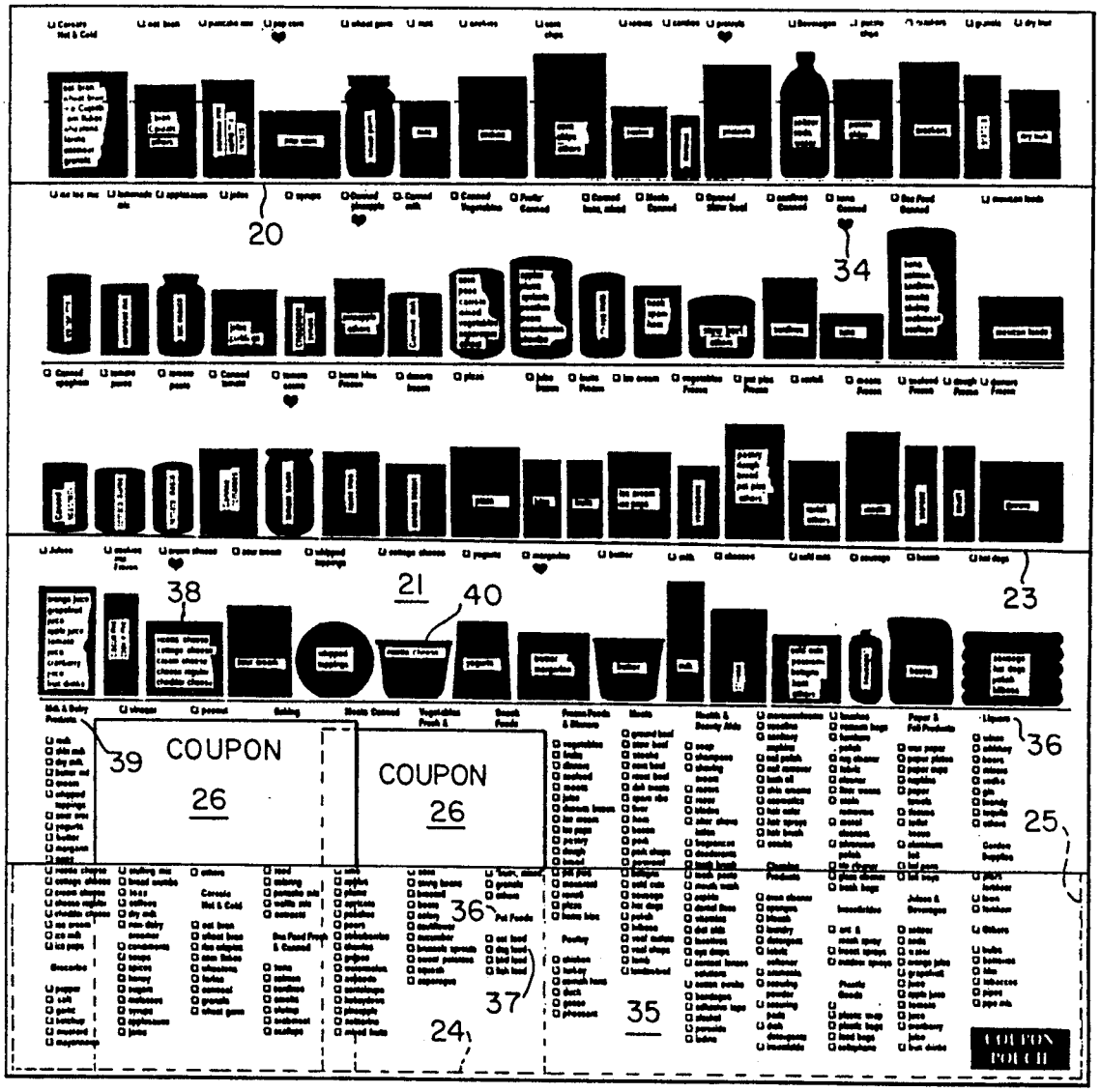
FIG. 3 is a front perspective view of the invention in the open position.

Turning now to FIG. 3, area 35 of the buyer's guide illustrates headings (36) for particular grocery departments which provide items of interest to the consumer. The headings, include lists (37) of products in the particular areas. Although some of the products in each particular area may be noted within the graphic indicators. As illustrated at 39, a complete list of items is provided for the consumer under each heading. For example, milk and dairy products as noted at 39 include ricotta cheese, cottage cheese, cream cheese, cheese regular, and cheddar cheese. These items are also listed within the graphic indicator as noted at 38 for aesthetic purposes, individual containers in graphic form may also be listed, as noted at 40 for ricotta cheese. Accordingly, marketing companies may choose to emphasize products which are either on sale or specially priced.

While various changes may be made in the detailed construction, it is understood that such changes would be within the spirit and scope of the present invention, as is defined by the appended claims.

I claim:

1. A promotional device including an insert having coupons, said device including;

a buying guide and check list article, said article detachably secured to said device, said article including at least one sheet having a first side, said first sheet including indicia representing lists of consumer products, said indicia including indicator means for indicating to the consumer that said coupons are available in said insert for said indicated products.

2. The structure of claim 1 wherein said check list and buying guide article includes a pouch for receiving coupons.

3. The structure of claim 1 wherein said check list and buying guide article includes graphic indicators illustrated on said sheet.

* * * * *